US009459642B2

(12) United States Patent
Chen et al.

(10) Patent No.: US 9,459,642 B2
(45) Date of Patent: Oct. 4, 2016

(54) LOW DROPOUT REGULATOR AND RELATED METHOD

(71) Applicant: Taiwan Semiconductor Manufacturing Company, Ltd., Hsin-Chu (TW)

(72) Inventors: Jerry Chen, Taipei (TW); Cheng-Hsiung Kuo, Jhubei (TW); Yue-Der Chih, Hsinchu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 153 days.

(21) Appl. No.: 13/942,125

(22) Filed: Jul. 15, 2013

(65) Prior Publication Data

US 2015/0015223 A1 Jan. 15, 2015

(51) Int. Cl.
*G05F 1/00* (2006.01)
*G05F 1/575* (2006.01)

(52) U.S. Cl.
CPC ..... *G05F 1/575* (2013.01)

(58) Field of Classification Search
CPC ..... G06F 1/10; G06F 1/46; G06F 1/461; G06F 1/462; G06F 1/56; G06F 1/561; G06F 1/562; G06F 1/563; G06F 1/565; G06F 1/575; G06F 1/59; H02M 3/156; H02M 3/158; H02M 1/36; H02M 2001/0003; H02M 2001/0032; H02M 2001/0045; H02M 2003/1566
USPC ..... 323/222–226, 269–275, 280–285, 323/311–317, 351; 327/535–543; 365/189.011, 226–229
See application file for complete search history.

(56) References Cited

U.S. PATENT DOCUMENTS

| | | | | |
|---|---|---|---|---|
| 5,631,547 | A * | 5/1997 | Fujioka | H01L 27/0218 323/273 |
| 5,689,460 | A * | 11/1997 | Ooishi | 365/189.07 |
| 6,373,233 | B2 * | 4/2002 | Bakker et al. | 323/282 |
| 6,798,284 | B2 * | 9/2004 | Oda | 330/86 |
| 7,142,044 | B2 * | 11/2006 | Sano | 327/540 |
| 2005/0212499 | A1 * | 9/2005 | Yasukouchi | H02M 3/156 323/282 |
| 2006/0097708 | A1 * | 5/2006 | Tanner et al. | 323/269 |
| 2006/0170401 | A1 * | 8/2006 | Chen | G05F 1/575 323/273 |
| 2010/0253431 | A1 * | 10/2010 | Fujiwara | 330/253 |
| 2014/0117958 | A1 * | 5/2014 | Price et al. | 323/281 |

* cited by examiner

*Primary Examiner* — Timothy J Dole
*Assistant Examiner* — Carlos Rivera-Perez
(74) *Attorney, Agent, or Firm* — Slater Matsil, LLP

(57) ABSTRACT

A device includes an error amplifier, a standby current source, a charging current source, a voltage divider, and a first switch. The error amplifier has a negative input terminal and a positive input terminal. The standby current source has a control terminal electrically connected to an output terminal of the error amplifier. The voltage divider has an input terminal electrically connected to an output terminal of the standby current source, and an output terminal electrically connected to the positive input terminal of the error amplifier. The charging current source has a control terminal electrically connected to the output terminal of the error amplifier. The first switch has a first terminal electrically connected to an input terminal of the charging current source, and a second terminal electrically connected to a first power supply node.

20 Claims, 6 Drawing Sheets

FIG. 4

LOW DROPOUT REGULATOR AND RELATED METHOD

BACKGROUND

The semiconductor industry has experienced rapid growth due to improvements in the integration density of a variety of electronic components (e.g., transistors, diodes, resistors, capacitors, etc.). For the most part, this improvement in integration density has come from shrinking the semiconductor process node (e.g., shrinking the process node towards the sub-20 nm node). Commensurate with shrunken dimensions is an expectation of greater immediacy (higher speed) and increased performance with reduced power consumption. A low-dropout (LDO) regulator is a voltage regulator characterized by a small difference between input voltage and output voltage. The LDO is characterized at least by drop-out voltage, standby current, and speed.

BRIEF DESCRIPTION OF THE DRAWINGS

For a more complete understanding of the present embodiments, and the advantages thereof, reference is now made to the following descriptions taken in conjunction with the accompanying drawings, in which.

DETAILED DESCRIPTION OF ILLUSTRATIVE EMBODIMENTS

The making and using of the present embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosed subject matter, and do not limit the scope of the different embodiments.

Embodiments will be described with respect to a specific context, namely low dropout (LDO) regulators and methods with beneficial standby current and speed. Other embodiments may also be applied, however, to other types of integrated devices.

Throughout the various figures and discussion, like reference numbers refer to like components. Also, although singular components may be depicted throughout some of the figures, this is for simplicity of illustration and ease of discussion. A person having ordinary skill in the art will readily appreciate that such discussion and depiction can be and usually is applicable for many components within a structure.

Integrated LDO regulators have many and various uses in integrated circuit (IC) applications. LDO regulators are rated in terms of performance metrics, including drop-out voltage, standby current, load regulation, line regulation, maximum current, speed (responsiveness in the presence of varying loads), and output voltage variations due to transients in load current, among others.

In the following disclosure, novel LDO regulators are introduced. The LDO regulators use an additional current supply and switching control to improve at least standby current and speed of the LDO regulators while maintaining power consumption.

Figure 1:
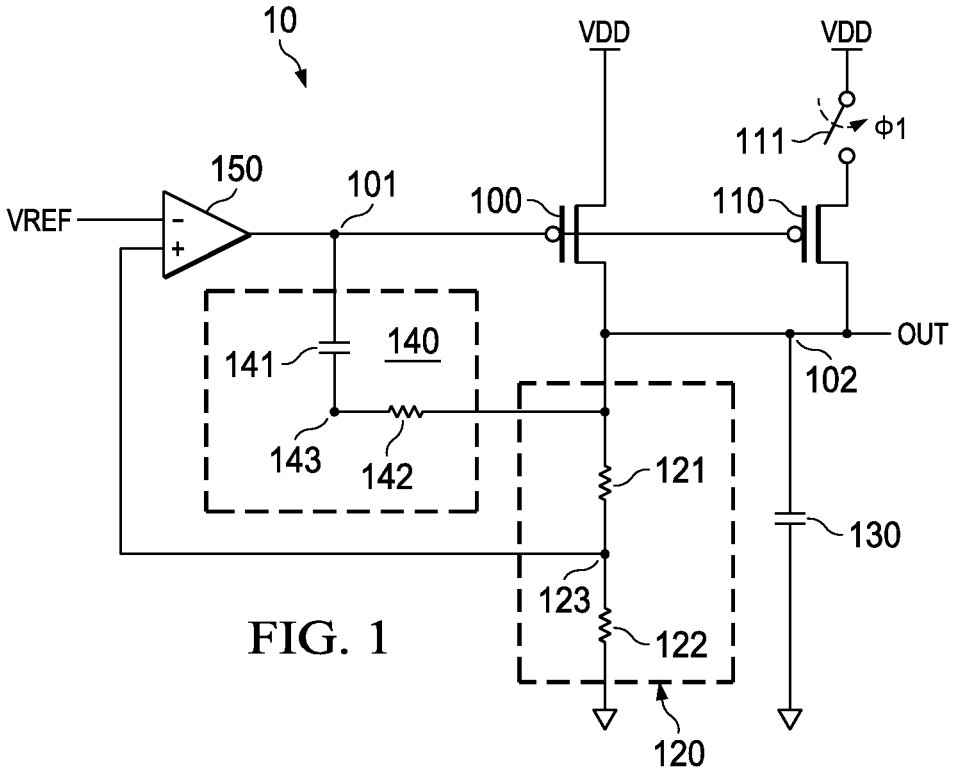
FIGS. 1, 6, 7, and 8 are diagrams of LDO regulators in accordance with various embodiments of the present disclosure.
Figure 6:
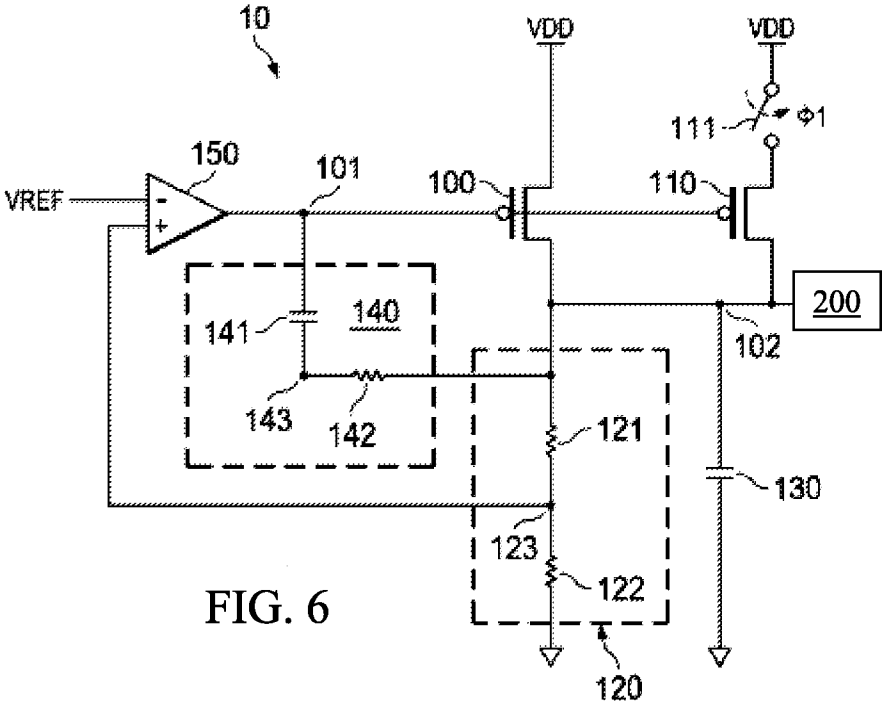

FIG. 1 is a diagram of an LDO regulator 10 in accordance with various embodiments of the present disclosure. Output voltage OUT of an output node 102 of the LDO regulator 10 is regulated through a feedback loop including voltage divider 120, error amplifier 150, standby current source 100, and charging current source 110. In an embodiment, the output voltage OUT provides charging current to an external circuit (e.g., external circuit 200 in FIG. 6).

The output voltage OUT is divided by the voltage divider 120. The voltage divider 120 is considered a feedback circuit having an input terminal electrically connected to an output terminal of the standby current source 100, and an output terminal electrically connected to a non-inverting input terminal of the error amplifier 150. A top resistor 121 of the voltage divider 120 is electrically connected to the output node 102 and a divider node 123. A bottom resistor 122 of the voltage divider 120 is electrically connected to the divider node 123 and a second voltage supply node (e.g., ground). Division of the output voltage OUT by the voltage divider 120 causes divided voltage at the divider node 123 to be a fraction of the output voltage OUT. The fraction is controlled by a ratio of resistance of the bottom resistor 122 to total resistance of the bottom resistor 122 and the top resistor 121.

Figure 7:
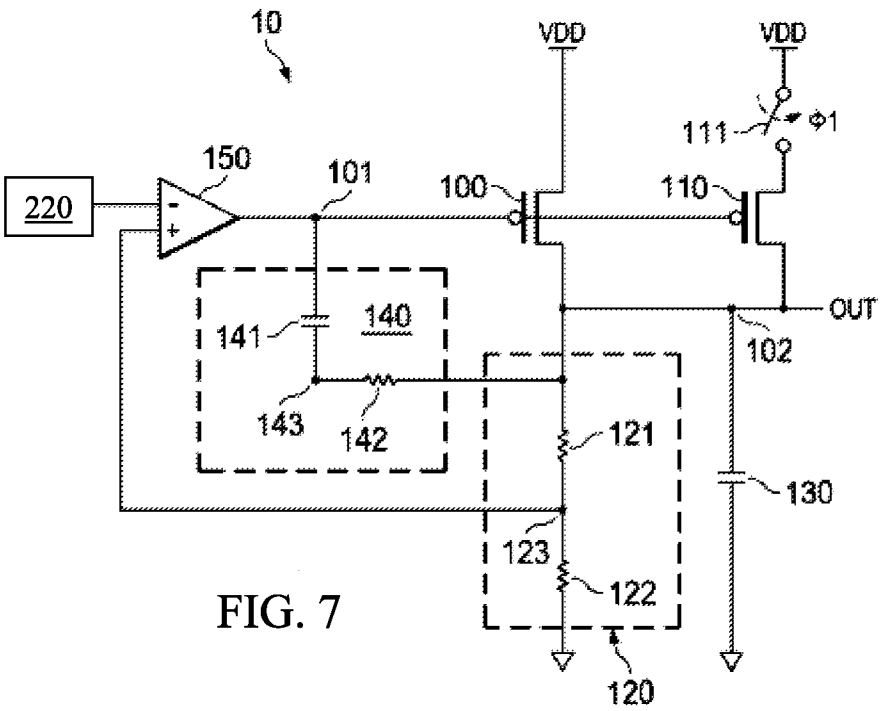

A first input terminal (e.g., a positive input terminal, non-inverting input terminal) of the error amplifier 150 is electrically connected to the divider node 123, and receives the divided voltage from the voltage divider 120. A second input terminal (e.g., a negative input terminal, inverting input terminal) of the error amplifier 150 is electrically biased by a reference voltage VREF. In some embodiments, the reference voltage VREF is generated by a bias circuit (e.g., bias circuit 220 in FIG. 7), such as a bandgap voltage reference. An output terminal of the error amplifier 150 is electrically connected to a gate node 101. Error voltage at the output terminal of the error amplifier 150 is a product of gain of the error amplifier 150 and difference between the reference voltage VREF and the divided voltage.

The error voltage controls the standby current source 100 and the charging current source 110. In some embodiments, the standby current source 100 is a P-type metal-oxide-semiconductor (PMOS) transistor. A gate electrode of the standby current source 100 is electrically connected to the gate node 101. A source electrode of the standby current source 100 is electrically connected to a first voltage supply node (e.g., VDD). A drain electrode of the standby current source 100 is electrically connected to the output node 102. The standby current source 100 has a first width (W1) and a first length (L1). A standby ratio, equaling the first width divided by the first length (W1/L1), is directly proportional to transimpedance (current/voltage) gain of the standby current source 100. For example, a larger standby ratio (W1/L1) causes greater output current for a given input voltage.

In some embodiments, the charging current source 110 is a PMOS transistor. A gate electrode of the charging current source 110 is electrically connected to the gate node 101. A source electrode of the charging current source 110 is electrically connected to a first voltage supply node (e.g., VDD) through a switch 111 (e.g., a pass gate, an NMOS transistor, a PMOS transistor, or the like). A drain electrode of the charging current source 110 is electrically connected to the output node 102. A first terminal of the switch 111 is electrically connected to the source electrode of the charging current source 110. A second terminal of the switch 111 is electrically connected to the first voltage supply node. The switch 111 is controlled by a switching signal ϕ1. The charging current source 110 has a second width (W2) and a second length (L2). A charging ratio, equaling the second width divided by the second length (W2/L2), is directly proportional to transimpedance (current/voltage) gain of the charging current source 110. For example, a larger charging ratio (W2/L2) causes greater output current for a given input voltage.

In some embodiments, the charging ratio is equal to the standby ratio. In some embodiments, the charging ratio is greater than the standby ratio by a multiple (whole or real). In some embodiments, the multiple is greater than 2. In some embodiments, the multiple is greater than 5. In yet further embodiments, the multiple is greater than 10 (e.g., 19).

In some embodiments, the standby current source 100 has a different threshold voltage than the charging current source 110. In some embodiments, the standby current source 100 has a higher threshold voltage than the charging current source 110.

In some embodiments, the standby current source 100, the charging current source 110, and the switch 111 form a variable current source. The variable current source has an approximately fixed current component provided by the standby current source 100, and a switchable current component provided by the charging current source 110.

In some embodiments, the charging current source 110 includes a plurality of transistors similar to the PMOS transistor 110, and a plurality of control switches similar to the switch 111. Each transistor is controlled by a corresponding control switch of the plurality of control switches. In some embodiments, the transistors of the plurality of transistors are independently enabled or disabled by the plurality of control switches.

A first electrode (top plate) of a first capacitor 130 is electrically connected to the output node 102. A second electrode (bottom plate) of the first capacitor is electrically connected to the second voltage supply node (e.g., ground).

A mirror compensation circuit 140 is electrically connected to the gate node 101 and the output node 102. The mirror compensation circuit 140 includes a third resistor 142 and a second capacitor 141. A first terminal of the third resistor 142 is electrically connected to the output node 102. A second terminal of the third resistor 142 is electrically connected to an internal node 143 of the mirror compensation circuit 140. A first terminal of the second capacitor 141 is electrically connected to the internal node 143. A second terminal of the second capacitor 141 is electrically connected to the gate node 101.

Figure 2:
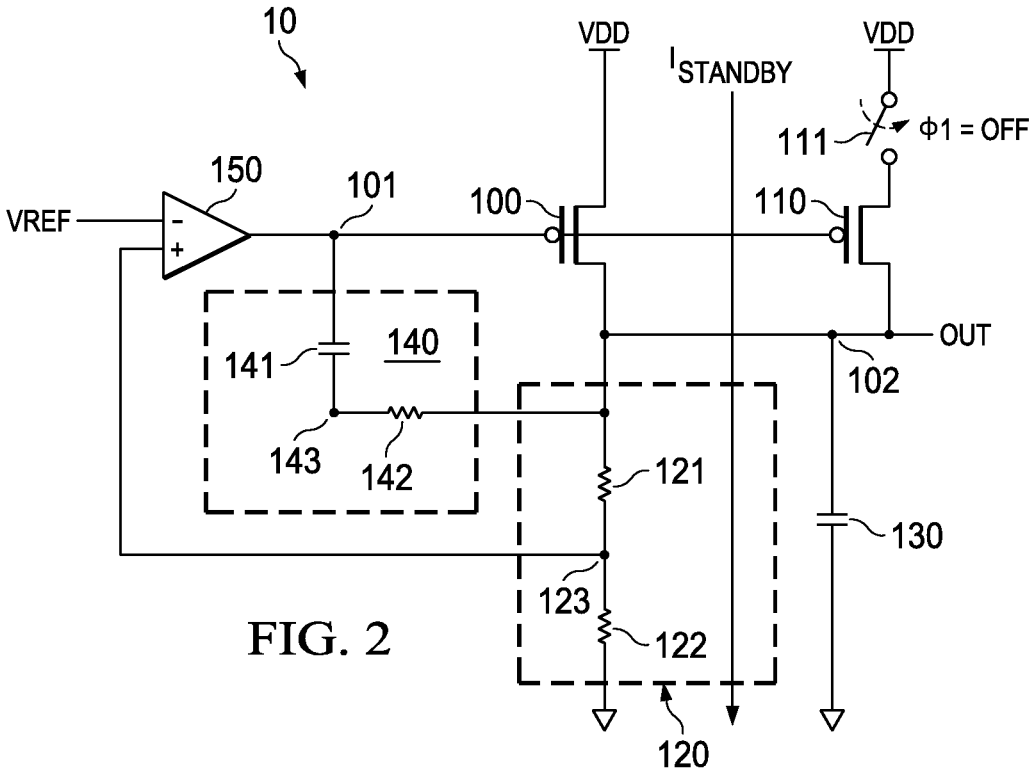
FIG. 2 is a diagram of the LDO regulator in a standby mode in accordance with various embodiments of the present disclosure.

FIG. 2 is a diagram of the LDO regulator 10 in a standby mode in accordance with various embodiments of the present disclosure. The switch 111 is off (open circuit) during the standby mode. The charging current source 110 is disabled (off) during the standby mode due to the open circuit between the source electrode of the charging current source 110 and the first voltage supply node due to the switch 111. Standby current $I_{STANDBY}$ is generated by the standby current source 100. The standby current $I_{STANDBY}$ charges the capacitor 130 to establish an output voltage level at the output node 102. The output voltage level is controlled by the reference voltage VREF at the negative input terminal of the error amplifier 150. When the output voltage level is relatively high, the divided voltage at the positive input terminal of the error amplifier 150 is increased relative to the reference voltage VREF. The increase in the divided voltage causes a proportional increase in the error voltage at the gate node 101. The increase in the error voltage reduces source-gate voltage ($V_{SG}$) of the standby current source 100, which causes a decrease in the standby current $I_{STANDBY}$. As a result, the output voltage level lowers. Through an opposite mechanism, a relatively low output voltage level pulls down the divided voltage and the error voltage, increasing the standby current $I_{STANDBY}$, and raising the output voltage level. A quiescent state is achieved over time through regulation of the standby current $I_{STANDBY}$ by the negative feedback loop control of the voltage divider 120, the error amplifier 150, and the standby current source 100. In the quiescent state, error voltage at the gate node 101 is relatively low due to the smaller size of the standby current source 100, as compared to other architectures that include only a single current source (e.g., only the charging current source). The lower error voltage is due to at least the first ratio being low, which translates into a higher source-gate voltage $V_{SG}$ needed to drive a given standby current $I_{STANDBY}$.

Figure 3:
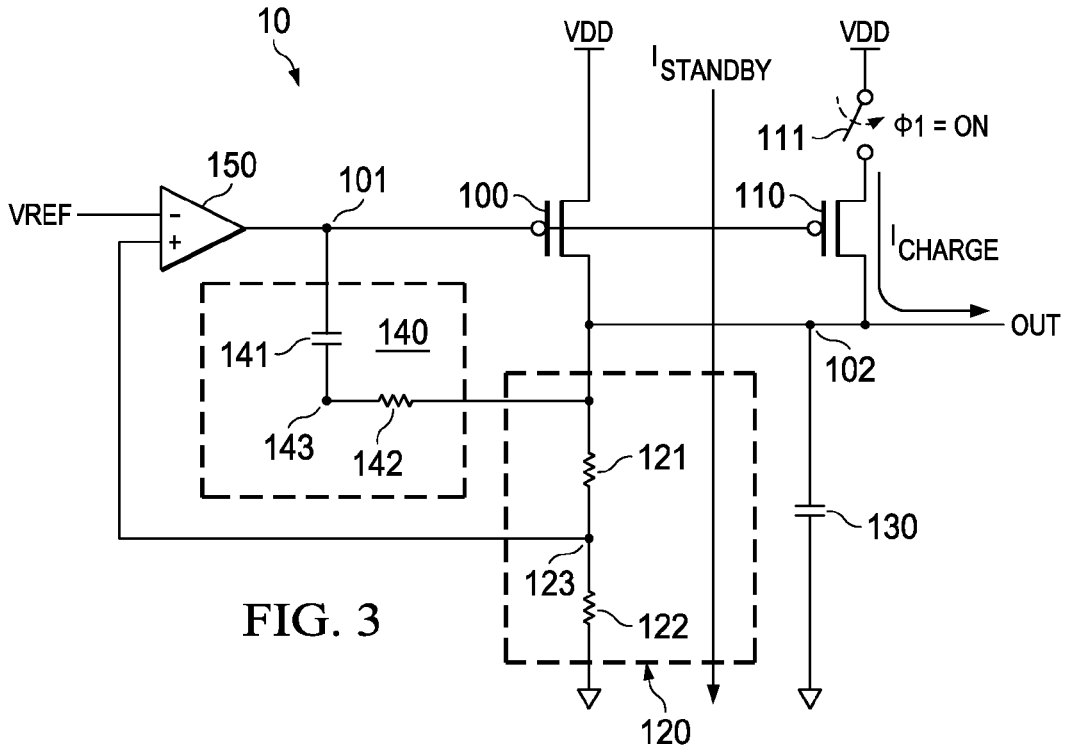
FIG. 3 is a diagram of the LDO regulator in a charging mode in accordance with various embodiments of the present disclosure.

FIG. 3 is a diagram of the LDO regulator 10 in a charging mode in accordance with various embodiments of the present disclosure. A transition from the standby mode to the charging mode is characterized by a change in load applied to the output node 102 of the LDO regulator 10. The load in the standby mode may be characterized as a light load, corresponding to high impedance (low current output). As the transition occurs, the load is switched to a heavy load, corresponding to low impedance (high current output). For example, in a memory application, the LDO regulator 10 may generate a voltage for a word line to read out data from at least one memory cell. In some memory applications, two word lines may switch in rapid succession (one word line charged to a read voltage, and the other word line discharged to ground), or different word lines may be charged randomly, for instance.

Figure 8:
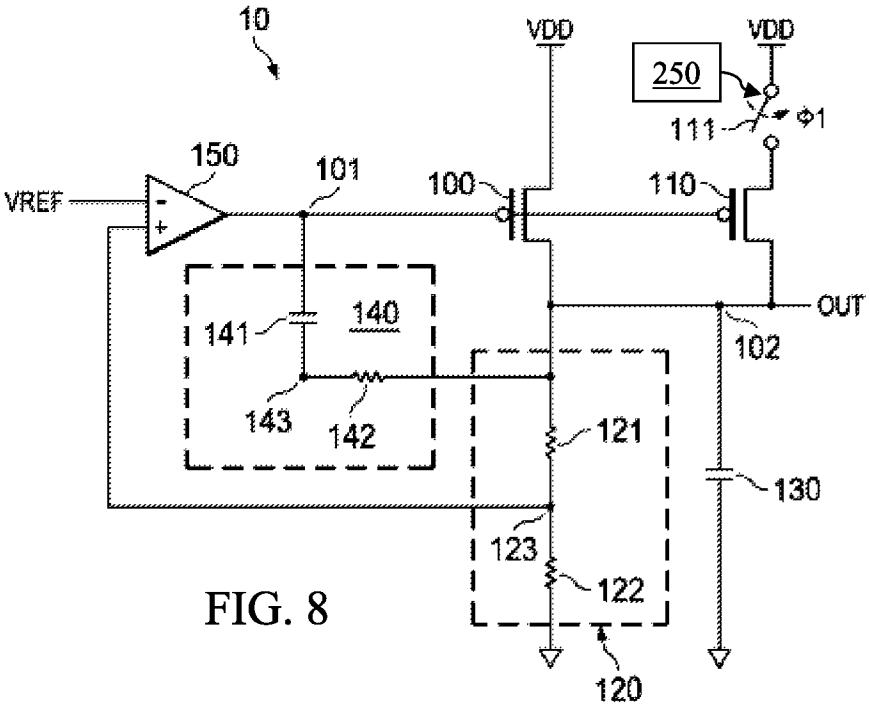

The heavy load in the transition to the charging mode corresponds to a transient drop in the output voltage OUT. In the charging mode, the switch 111 is turned on (short circuited). In some embodiments, the switch 111 is turned on by a pulsing signal generated by a pulse generator (e.g., pulse generator 250 in FIG. 8). With the error voltage relatively low following the standby mode, both the standby current source 100 and the charging current source 110 are strongly turned on. The lowered output voltage OUT drops the divided voltage. When compared to the reference voltage VREF through the error amplifier 150, the divided voltage causes the error amplifier 150 to lower the error voltage further. The minor compensation circuit 140 also pulls down the error voltage through capacitive coupling by the second capacitor 141. As a result, the standby current source 100 and the charging current source 110 rapidly charge the heavy load, both tightening amplitude of the drop in the output voltage OUT, and speeding recovery of the output voltage OUT to a stable voltage level.

Figure 4:
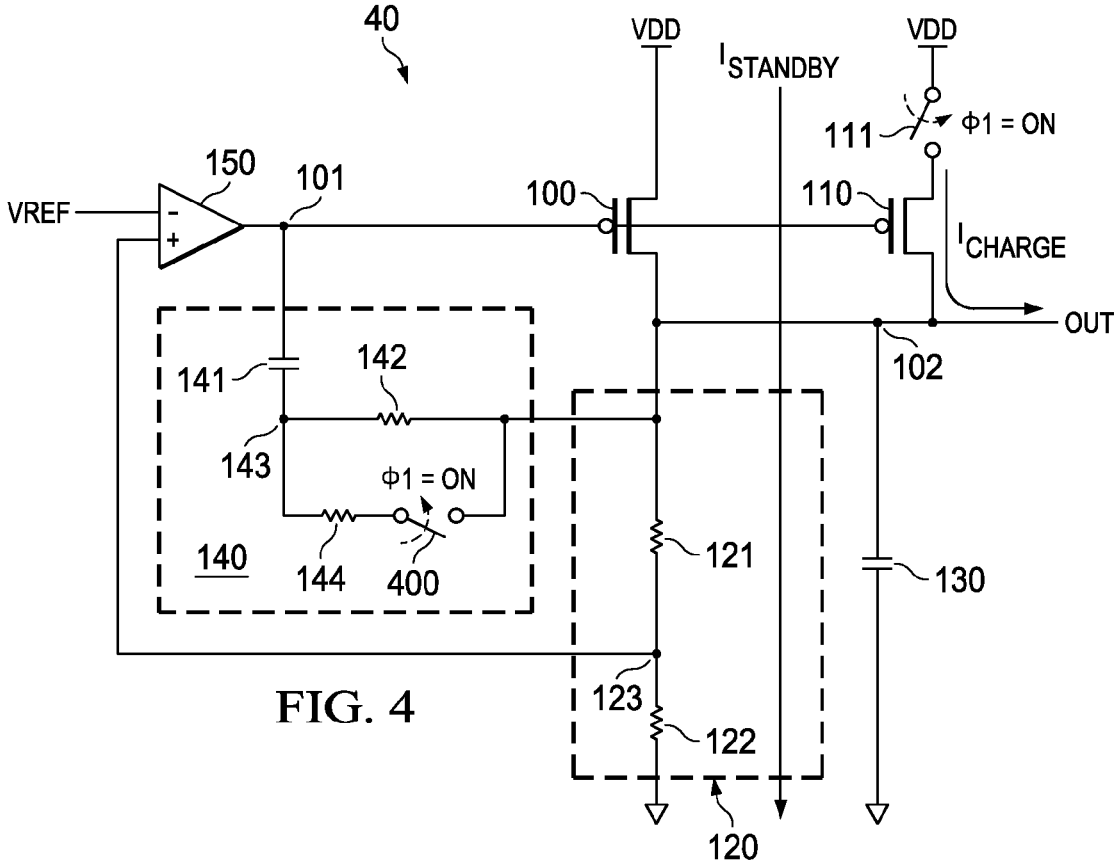
FIG. 4 is a diagram of an LDO regulator in a charging mode in accordance with various embodiments of the present disclosure.

FIG. 4 is a diagram of an LDO regulator 40 in a charging mode in accordance with various embodiments of the present disclosure. The LDO regulator 40 is similar to the LDO regulator 10, and further includes a second switch 400 as part of the mirror compensation circuit 140. In some embodiments, the second switch 400 is a pass gate, an NMOS transistor, a PMOS transistor, or the like. A first terminal of the second switch 400 is electrically connected to the internal node 143 of the mirror compensation circuit 140. A second terminal of the second switch 400 is electrically connected to the output node 102. In some embodiments, the first terminal of the second switch 400 is electrically connected to the internal node 143 through a fourth resistor 144. In some embodiments, the second switch 400 is controlled by the switching signal ϕ1. In some embodiments, the second switch 400 is controlled independently of the switch 111. In some embodiments, the LDO regulator 40 includes both the switch 111 and the second switch 400. In some embodiments, the LDO regulator 40 does not include the switch 111.

The second switch 400 is controlled to close when the load is a heavy load, and to open when the load is a light load. Closing the second switch 400 shorts out the third resistor 142 by creating an alternate current path between the internal node 143 and the output node 102. Opening the second switch 400 removes the alternate current path, so that current from the output node 102 travels to the internal node 143 through the third resistor 142. When the load is a light load (e.g., in the standby mode), stability is preferred over speed. Thus, the second switch 400 is open during the standby mode to promote stability in the output voltage OUT. When the load is a heavy load (e.g., in the charging mode), speed is preferred over stability. Thus, the second switch 400 is closed during the charging mode. By closing the second switch 400, the first terminal of the second capacitor 141 is charged more readily in response to changing voltage at the output node 102. In some embodiments, the alternate current path further includes a resistor in series with the second switch 400.

Figure 5:
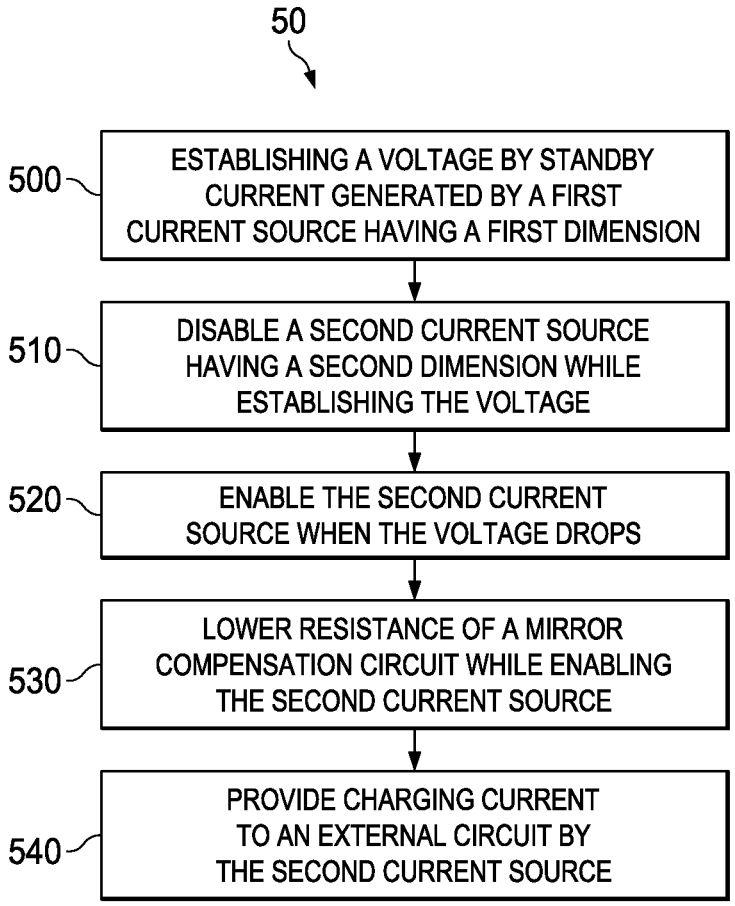
FIG. 5 is a flowchart of a process for regulating a voltage in accordance with various embodiments of the present disclosure.

FIG. 5 is a flowchart of a process 50 for regulating a voltage in accordance with various embodiments of the present disclosure. In some embodiments, the process 50 is utilized in the LDO regulator 10 or the LDO regulator 40. It is understood that additional steps can be provided before, during, and after the process 50, and some of the steps described can be replaced, eliminated, or moved around for additional embodiments of the process. The process 50 is an example, and is not intended to limit the present invention beyond what is explicitly recited in the claims.

A first voltage is established by the standby current $I_{STANDBY}$ of the standby current source 100 in operation 500. In some embodiments, the first voltage is established by charging the capacitor 130. The standby current source 100 has a first dimension (e.g., width). In some embodiments, the first dimension is transistor width. In some embodiments, the first dimension is a ratio of transistor width over transistor length (e.g., W1/L1). In some embodiments, the first dimension is number of transistor fingers.

The charging current source 110 is disabled in operation 510. The charging current source 110 has a second dimension (e.g., width). In some embodiments, the second dimension is transistor width. In some embodiments, the second dimension is a ratio of transistor width over transistor length (e.g., W2/L2). In some embodiments, the second dimension is number of transistor fingers. In some embodiments, the second dimension is less than the first dimension. In some embodiments, the second dimension equals the first dimension. In some embodiments, the second dimension is greater than the first dimension. In some embodiments, the operation 510 begins concurrently with the operation 500. In some embodiments, the operations 500 and 510 are performed in the standby mode.

The charging current source 110 is enabled in operation 520. In some embodiments, the charging current source 110 is enabled by closing the switch 111. In some embodiments, the operation 520 starts concurrently with the beginning of a transition from the standby mode to the charging mode. In some embodiments, the operation 520 is performed at least while voltage across the first capacitor 130 is lower than the first voltage. In some embodiments, the operation 520 is performed when the voltage drops to a second voltage lower than the first voltage, and continues until the voltage returns to about the first voltage (e.g., within 5-10% of the first voltage). In some embodiments, the operation 520 is performed during a read operation, and continues until at least an end of the read operation.

In some embodiments, resistance of the mirror compensation circuit 140 is lowered in operation 530. In some embodiments, the resistance is lowered by closing the second switch 400. In some embodiments, the operation 530 begins and ends concurrently with the operation 520 (e.g., the switch 111 and the second switch 400 are controlled by the same switching signal ϕ1). In some embodiments, lowering the resistance is shorting out the third resistor 142 to drop the resistance to substantially zero ohms. In some embodiments, lowering the resistance is switching in a fourth resistor in parallel with the third resistor 142 to drop the resistance to a value greater than zero ohms and less than the resistance of the third resistor 142 or the fourth resistor.

An external circuit, such as a memory circuit, is provided charging current by at least the charging current source 110 in operation 540. In some embodiments, the operation 540 begins and ends concurrently with the operation 520. In some embodiments, the operation 540 begins and ends concurrently with the operations 520 and 530. In some embodiments, the charging current is provided by both the charging current source 110 and the standby current source 100. In some embodiments, the charging current is controlled by a biasing voltage (e.g., the error voltage at the error node 101) that is increased by the first dimension being relatively small, and capacitive coupling of the mirror compensation circuit.

Embodiments may achieve advantages. The standby and charging current sources 100, 110 of the LDO regulators 10 and 40 are driven by larger control voltage (e.g., $V_{SG}$) set up in the standby mode. Further, in the LDO regulator 40, the mirror compensation circuit 140 using variable resistance increases responsiveness of the mirror compensation circuit 140 in transitions from light loads to heavy loads. The LDO regulators 10 and 40 have good stability when driving light loads, and good speed when driving heavy loads.

In accordance with various embodiments of the present disclosure, a device comprises an error amplifier, a standby current source, a charging current source, a voltage divider, and a first switch. The error amplifier has a negative input terminal and a positive input terminal. The standby current source has a control terminal electrically connected to an output terminal of the error amplifier. The voltage divider has an input terminal electrically connected to an output terminal of the standby current source, and an output terminal electrically connected to the positive input terminal of the error amplifier. The charging current source has a control terminal electrically connected to the output terminal of the error amplifier. The first switch has a first terminal electrically connected to an input terminal of the charging current source, and a second terminal electrically connected to a first power supply node.

In accordance with various embodiments of the present disclosure, a device comprises an error amplifier, a variable current source, a feedback circuit, and a compensation circuit. The variable current source has a control terminal electrically connected to an output terminal of the error amplifier. The feedback circuit comprises a first resistor having a first terminal electrically connected to an output terminal of the variable current source, and a second resistor having a first terminal electrically connected to a second terminal of the first resistor and a non-inverting input terminal of the error amplifier. The compensation circuit comprises a capacitor having a first terminal electrically connected to the output terminal of the error amplifier, and a variable resistor having a first terminal electrically connected to a second terminal of the capacitor, and a second terminal electrically connected to the output terminal of the variable current source.

In accordance with various embodiments of the present disclosure, a method comprising establishing a voltage at a first voltage level by a first current source having a first dimension, disabling a second current source having a second dimension during the establishing, enabling the second current source when the voltage drops below the first voltage level, and charging an external circuit by the second current source at least until the voltage returns to the first voltage level.

As used in this application, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used in either the detailed description or the claims, such terms are intended to be inclusive in a manner similar to the term "comprising". Moreover, the term "between" as used in this application is generally inclusive (e.g., "between A and B" includes inner edges of A and B).

Although the present embodiments and their advantages have been described in detail, it should be understood that various changes, substitutions, and alterations can be made herein without departing from the spirit and scope of the disclosure as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A device comprising:

an error amplifier having a negative input terminal and a positive input terminal;

a standby current source having a control terminal electrically connected to an output terminal of the error amplifier, wherein the standby current source has a first transistor and a standby ratio equal to a first channel width of the first transistor divided by a first channel length of the first transistor;

a voltage divider having:

an input terminal electrically connected to an output terminal of the standby current source, and an output terminal electrically connected to the positive input terminal of the error amplifier;

a charging current source having a control terminal electrically connected to the output terminal of the error amplifier, wherein the charging current source has a second transistor and a charging ratio equal to a second channel width of the second transistor divided by a second channel length of the second transistor, wherein the charging ratio is at least twice as large as the standby ratio;

a first switch having:

a first terminal electrically connected to an input terminal of the charging current source, and a second terminal electrically connected to a first power supply node; and a compensation circuit having:

a first capacitor, wherein a first terminal of the first capacitor is electrically coupled to the output terminal of the error amplifier;

a first resistor, wherein a first terminal of the first resistor is electrically coupled to a second terminal of the first capacitor, and a second terminal of the first resistor is electrically coupled to the input terminal of the voltage divider;

a second resistor, wherein a first terminal of the second resistor is electrically coupled to the second terminal of the first capacitor; and a second switch, wherein a first terminal of the second switch is electrically coupled to a second terminal of the second resistor, and a second terminal of the second switch is electrically coupled to the input terminal of the voltage divider;

wherein the second switch is configured to close when the charging current source provides a driving current to the output terminal of the standby current source, and wherein the second switch and the charging current source are configured to be controlled by a same control signal.

2. The device of claim 1, wherein:

the standby current source has a first threshold voltage;

the charging current source has a second threshold voltage; and the first threshold voltage is higher than the second threshold voltage.

3. The device of claim 1, further comprising:

a pulse generator electrically connected to a control terminal of the first switch.

4. The device of claim 1, further comprising:

a bias circuit having an output terminal electrically connected to the negative input terminal of the error amplifier.

5. The device of claim 1, wherein the output terminal of the standby current source is electrically connected to an output terminal of the charging current source.

6. The device of claim 1, wherein the voltage divider comprises a third resistor and a fourth resistor coupled in series between the output terminal of the standby current source and a reference voltage level.

7. The device of claim 1, wherein the first transistor and the second transistor are P-type metal-oxide-semiconductor (PMOS) transistors.

8. A device comprising:

an error amplifier;

a variable current source having a control terminal electrically connected to an output terminal of the error amplifier, wherein the variable current source comprises a first switchable current source having a first transistor and a second current source having a second transistor, the first transistor and the second transistor having a first threshold voltage and a second threshold voltage, respectively;

a feedback circuit comprising:

a first resistor having a first terminal electrically connected to an output terminal of the variable current source; and a second resistor having a first terminal electrically connected to a second terminal of the first resistor and a non-inverting input terminal of the error amplifier; and a compensation circuit comprising:

a capacitor having a first terminal electrically connected to the output terminal of the error amplifier; and a variable resistor having a first terminal electrically connected to a second terminal of the capacitor, and a second terminal electrically connected to the output terminal of the variable current source, wherein the second terminal of the variable resistor and the output terminal of the variable current source have a same voltage, wherein the variable resistor comprises:

third resistor having a first terminal electrically connected to the second terminal of the capacitor; and a switch having a first terminal electrically connected to a first terminal of the third resistor, and a second terminal electrically connected to the output terminal of the variable current source;

wherein a resistance of the variable resistor is configured to decrease when the first switchable current source provides a charging current to the output terminal of the variable current source, wherein the switch and the first switchable current source are configured to be controlled by a same control signal.

9. The device of claim 8, wherein the first terminal of the switch is electrically connected to the first terminal of the third resistor through a fourth resistor.

10. The device of claim 8, further comprising a pulse generator having an output terminal electrically connected to a control terminal of the first switchable current source.

11. The device of claim 8, further comprising a second capacitor having a first terminal electrically connected to the output terminal of the variable current source, and a second terminal electrically connected to ground.

12. The device of claim 8, wherein the variable resistor further comprises:

a fourth resistor having a first terminal electrically connected to the second terminal of the capacitor, and a second terminal electrically connected the first terminal of the switch.

13. The device of claim 8, wherein the second threshold voltage is higher than the first threshold voltage.

14. The device of claim 8, wherein the first transistor has a first ratio defined as a channel width of the first transistor divided by a channel length of the first transistor, wherein the second transistor has a second ratio defined as a channel width of the second transistor divided by a channel length of the second transistor, and wherein the first ratio is at least twice as large as the second ratio.

15. The device of claim 8, further comprising: a bias circuit with an output terminal coupled to a negative input terminal of the error amplifier.

16. The device of claim 8, wherein the switch is a pass gate, an N-type metal-oxide-semiconductor (NMOS) transistor, or a P-type metal-oxide-semiconductor (PMOS) transistor.

17. A method comprising:

establishing a voltage at a first voltage level by a first current source having a first transistor with a first threshold voltage;

disabling a second current source having a second transistor with a second threshold voltage during the establishing, wherein the second threshold voltage is lower than the first threshold voltage;

enabling the second current source when the voltage drops below the first voltage level;

lowering resistance of a compensation circuit electrically connected to the second current source during the enabling, wherein the lowering and the enabling are controlled by a same control signal, wherein the compensation circuit comprises a capacitor coupled in series with a variable resistor, with the variable resistor comprising a first resistor and a switch coupled in parallel to the first resistor, wherein the lowering comprises closing the switch; and charging an external circuit by the second current source at least until the voltage returns to the first voltage level.

18. The method of claim 17, wherein:

the establishing is establishing the voltage at the first voltage level by the first current source having the first transistor, the first transistor having a first ratio between a channel width and a channel length of the first transistor; and the disabling is disabling the second current source having the second transistor during the establishing, the second transistor having a second ratio between a channel width and a channel length of the second transistor, the second ratio being at least twice as large as the first ratio.

19. The method of claim 17, wherein:

the charging is charging the external circuit by the second current source until an end of a read operation of the external circuit.

20. The method of claim 17, wherein:

the charging comprises controlling a switch electrically connected to the second current source by a pulse generator during a read operation of the external circuit.

* * * * *